United States Patent [19]

Aoki et al.

[11] Patent Number: 5,011,388

[45] Date of Patent: Apr. 30, 1991

[54] OIL-FREE SCREW COMPRESSOR APPARATUS

[75] Inventors: Masakazu Aoki; Akira Suzuki, both of Shimizu, Japan

[73] Assignee: Hitachi, Ltd., Tokyo, Japan

[21] Appl. No.: 343,496

[22] Filed: Apr. 25, 1989

[30] Foreign Application Priority Data

Apr. 28, 1988 [JP] Japan ..... 63-107313

[51] Int. Cl.[5] ..... F04C 18/16; F04C 29/02

[52] U.S. Cl. ..... 418/95; 418/DIG. 1; 418/201.1; 184/6.24

[58] Field of Search ..... 418/DIG. 1, 88, 84, 418/201 R, 95; 184/6.24

[56] References Cited

U.S. PATENT DOCUMENTS

| | | | |
|---|---|---|---|
| 3,905,729 | 9/1975 | Bauer | 418/84 |
| 4,035,114 | 7/1977 | Sato | 418/84 |
| 4,632,650 | 12/1986 | Frieden et al. | 418/95 |
| 4,725,210 | 2/1988 | Suzuki et al. | 418/88 X |

FOREIGN PATENT DOCUMENTS

| | | | |
|---|---|---|---|
| 79300 | 5/1982 | Japan | 417/189 |
| 212394 | 12/1982 | Japan | 418/DIG. 1 |
| 59-51189 | 3/1984 | Japan . | |
| 59-51190 | 3/1984 | Japan . | |
| 59-93974 | 5/1984 | Japan . | |
| 59-79093 | 8/1984 | Japan . | |

*Primary Examiner*—John J. Vrablik
*Assistant Examiner*—David L. Cavanaugh
*Attorney, Agent, or Firm*—Antonelli, Terry, Stout & Kraus

[57] ABSTRACT

An oil-free screw compressor prevents a filter for separating oil mist from a gear case exhaust gas from clogging due to increase pressure loss in the filter, thereby suppressing increasing of an gear case inner pressure and further ensuring a removing of the oil mist from the exhaust gas. The oil-free screw compressor comprises a gear case exhaust pipe connected to a filter container containing a filter element for separating the oil mist, and a vacuum ejector having a suction port connected to second side space of the filter element contained in the container so as to make the pressure of the second side space of the filter element in the container negative pressure.

18 Claims, 8 Drawing Sheets

OIL-FREE SCREW COMPRESSOR APPARATUS

BACKGROUND OF THE INVENTION

1. Field of the Invention

The present invention relates to an oil-free screws compressor apparatus, and particularly an oil-free screw compressor apparatus having an improvement of separating oil mist included in the exhaust gas in a gear case of the apparatus.

2. Description of the Prior Art

Generally, a screw compressor includes a male screw rotor and a female screw rotor engaging with each other to rotate in a rotor casing so that the gas, typically, air suctioned from a suction side thereof into the rotor casing is compressed and then discharged therefrom.

In an usual screw compressor, oil is used to seal, lubricate and cool between both rotors and between each rotor and the rotor casing, respectively.

On the other hand, in an oil-free screw compressor, for the purpose of obtaining compressed air including no percentage of oil, oil is not introduced into a rotor casing at all, and as a male and a female rotors hold a narrow gap between both rotors in non-contact state, timing gears mounted on shafts of both rotors and located at the outside of the rotor casing, are engaged with each other in such a manner as to make both rotors rotate in non-contact, synchronous and high speed state. Both rotor shafts are supported by bearings located outside of the rotor casing, with these bearings and timing gears being lubricated by oil. A visco-seal of non-contact type prevents oil from entering into the rotor casing and a carbon-seal of non-contact type suppresses the leakage of air from inside of the rotor casing, with the seals being mounted on the rotor shafts at the suction side and the discharge side of the rotor casing. Further, the rotor shafts having a cooling hole axially passing therethrough so that oil is introduced into the hole through an oil suppling nozzle for cooling located at one end of the rotor shaft and the oil flows out of other end of the rotor shaft to cool the rotor, with cooling water flowing at the periphery of the rotor casing. The inner structure of the above-mentioned screw compressor is well-known.

In the compressor apparatus of FIG. 2, an oil-free screw compressor 1, including the inner structure described above is mounted on a gear case 2, in which a rotor shaft of the compressor 1 is over-driven by an over-drive gear 3 through a gear shaft driven by a pulley 11 to be rotated in the predetermined high-speed rotation. A lower portion of the gear case 2 serves as an oil-reservoir 9 from which the oil suctioned to a oil pump 4 through an oil filter 5, is cooled in an oil cooler 7 to be supplied to a rotor bearing inside of the compressor 1, the oil suppling nozzle for cooling the inner portion of the rotors, timing gears and the overdrive gear 3 etc. to lubricate the same.

Subsequent to lubricating the rotor bearing at the exhaust side, timing gear etc., the oil inside of the compressor 1 is discharged from the oil discharging port 8 to be recovered in the gear case 2 through the oil discharging pipe 12. And, subsequent to lubricating the rotor bearings at the suction side of the compressor 1 the oil is discharged from the oil discharging port 10 to be recovered in the gear case 2. Further, the oil introduced into the cooling hole in the rotor shaft from the oil supplying nozzle for cooling is recovered in the gear case 2 through the end of the rotor shaft at the suction side thereof. Therefore, oil smoke is generated in the gear case 2. On the other hand, since the visco-seal located in the compressor 1 is of a no-contact type and it is necessary to suppress back pressure (i.e. the inner pressure of the gear case 2) at low value thereof in order to maintain the performance of the compressor 1, the inner pressure of the gear case 2 is suppressed at low value thereof by conducting the air inside of the gear case 2 into the exhaust pipe B connected to the gear case 2. Since a very small amount of air leaking from the rotor casing in the compressor 1 flows into the gear case 2 through the exhaust pipe 12, the oil smoke in the gear case 2 flows into the gear case exhaust pipe B. An outlet A of the gear case exhaust pipe B projects to the outdoors so that the oil mist 13 does not enter into an air suction port of the oil-free screw compressor 1.

The above-mentioned prior art are disclosed in Japanese Patent Laid-Open No. 59-51190 and No. 59-51189 with respect to the seal structure of a compressor, in Japanese Patent Laid-Open No. 59-79093 with respect to the casing structure of a compressor, and in Japanese Patent Laid-Open No. 59-93974 with respect to a driving system of a compressor.

It is undesirable to exhaust the oil mist from the outlet of the gear case exhaust pipe B, even if the oil mist is exhausted to the outdoors. Further, it may impossible to exhaust the oil mist to the outdoors in location such as, for example a basement. Therefore, a filter element for removing the oil mist is mounted on the gear case exhausting pipe B, and a suction fan is mounted on the second or downstream side of the filter element.

However, in the above-mentioned prior art with respect to the removal of the oil mist in the gear case exhaust pipe, the pressure loss is increased as a part of the oil is collected in the filter element. Accordingly, there is a problem that the inner pressure of the gear case 2 exceeds the pressure of 40–100 $mmH_2O$ which is in limit of the performance in the visco-seal inside of the compressor 1. Although it may be possible to suppress the pressure loss to a certain extent by increasing filtering area of the filter element and to suppress the increasing speed of the pressure loss, the sizes of a fan and a filter element are remarkably increased when compared with the compressor. Thus, this is not a practical approach. Also, although it may be possible to remove the oil mist by attaching an electric dust collector etc. to the compressor apparatus, this approach makes the overall compressor system large and expensive, and also is not a practical approach.

SUMMARY OF THE INVENTION

It is the object of the invention to provide a small size and inexpensive oil-free screw compressor, in which clogging of the filter for removing the oil mist from the gear case exhaust gas is prevented, an increased of the inner pressure of the gear case in accordance with increasing of the pressure loss is suppressed, and the oil mist is certainly removed from the gear case exhaust gas.

This object of the invention is accomplished by an oil-free screw compressor as follows.

An oil-free screw compressor according to the present invention comprises a gear case integrally mounted on an oil-free screw compressor and containing gears for driving a rotor shaft of the compressor. Oil in the gear case is supplied from the gear case to the compressor and discharged into the gear case, with a gear case exhaust pipe connected to the gear case. A filter container is connected to the gear case and containing a filter element for separating oil mist, and a vacuum ejector is provided for making the pressure of the second side space of the filter element in the container a negative pressure.The vacuum ejector has a suction port connected to the second side space of the filter element in the container.

In accordance with the features of the present invention, since the pressure at the second side of the filter element is a negative pressure by virture of the provision of the vacuum ejector, it is possible to to increase the flow speed of gas passing through a filter element and the oil mist captured by the filter element does not form an oil film. When an amount of the oil mist increases to more than a predetermined amount, the oil mist forms an oil drops and drops from the filter element. In such a state, the pressure loss of the filter element is saturated with at a predetermined value thereof.

Accordingly, since the present invention enables a passing of stable gas through the filter element and capture the oil mist therein, the inner pressure of the gear case does not exceed the allowable value therefor.

DETAILED DESCRIPTION OF THE PREFERRED EMBODIMENT

In an oil-free screw compressor, the allowable pressure loss of exhaust gas in a gear case is 10–20 $mmH_2O$ as the maximum value therefor. Then, the flow rate of air exhausted from the gear case is a very small amount such as 50–200 l/min. When an oil film is formed on a filter element for removing the oil mist, the pressure loss increases in the case of such a very small amount to exceed the allowable pressure loss during a short time. Because it is noted that the important point is not to permit a development of a positive inner pressure in the present invention has resolved the problem by providing a vacuum ejector for maintaining the negative pressure at the second side of the filter for removing oil mist from the exhaust gas of the gear case.

Figure 1:
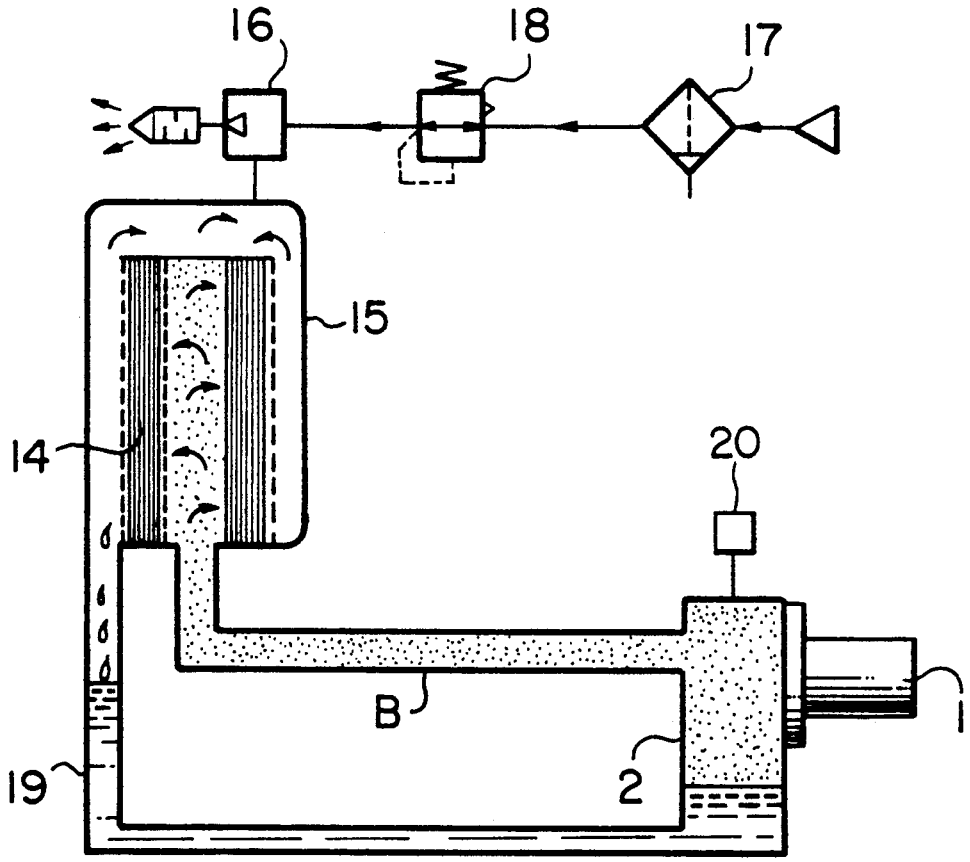
FIG. 1 is a schematic view of one embodiment of an oil free screw compressor constructed in accordance with the present invention.
Figure 2:
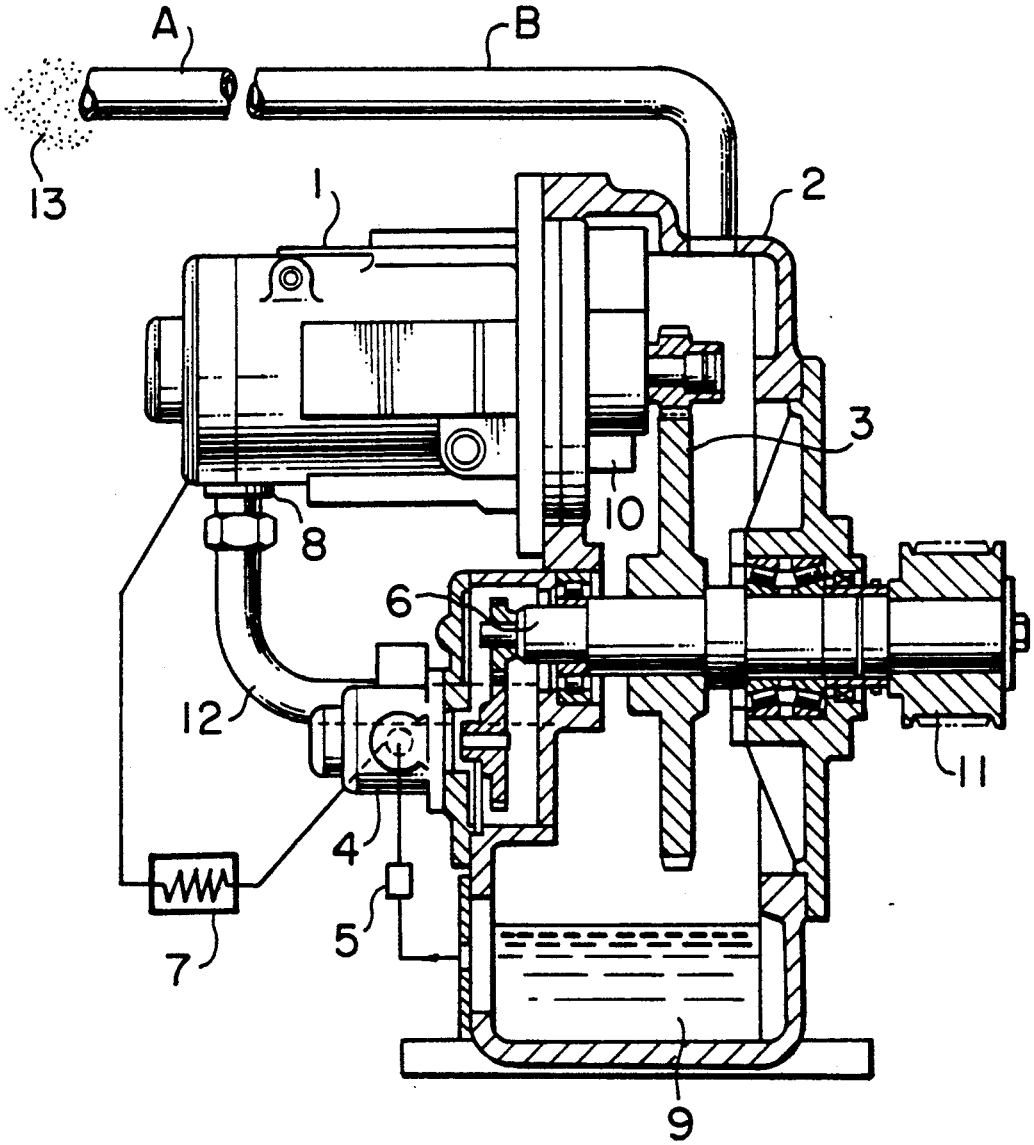
FIG. 2 is a partial cross-sectional elevational view of a conventional compressor apparatus including a driving system.

As shown in FIG. 1, in accordance with the present invention, a container 15 accommodates a filter element 14 for separating oil mist having suitable size and is mounted on a gear case exhaust pipe B, so that the pressure in the container 15 at the second side of the filter 14 is maintained at a negative pressure by exhausting gas by a vacuum ejector mounted on the container 15. Compressed air is supplied to the vacuum ejector 16 after passing through an air filter 17 from the compressed air and the pressure of the compressed air is reduced to a suitable pressure by a pressure reducing valve 18. This compressed air can be removed from downstream of an after-cooler. An amount of the compressed air needed in the ejector 16 is a very small one (0.5% or less than that of an air amount discharged from the compressor), so that consumption of the compressed air is negligible.

In accordance with the structure mentioned before, a flow speed of the air passing through a filter element 14 due to the negative pressure generated at the second side of the filter element 14 by the ejector 16 can be increased at a high speed. Accordingly, the oil mist captured or trapped in the filter element 14 does not form an oil film but drops off as oil drops from the filter element 14 when an amount of the oil mist exceeds a predetermined amount, thereby allowing the pressure loss of the filter element 14 to be saturated at the predetermined value thereof. Thus, it is possible to stably pass the air therethrough and trap the oil mist thereon, thereby allowing the inner pressure of the gear case 2 not to exceed the allowable pressure.

The oil dropped off as an oil drop is recovered in the gear case 2 through a recovery pipe 19. Since the inner pressure of the gear case 2 and the gear case exhaust pipe B is suitably controlled by adjusting the pressure reducing valve 18, the stable separation of the oil mist is always effected without the risk of increasing the inner pressure of the gear case 2 one the saturation point of the pressure loss in the filter element 14 is determined. The inner pressure of the gear case 2 or the gear case exhaust pipe B is controlled by mounting a pressure gauge or a differential pressure gauge 20 thereon. If a very low pressure sensor is mounted thereon, an alarm signal advising if the need for maintenance of the filter element may be provided indicating that the filter element 14 is clogged and/or approaching a normal service life. Also, a safety valve may be provided on the upstream side of the filter element 14, so that it is opened when the inner pressure of the gear case 2 or the gear case exhaust pipe B is unusually increased.

Figure 3:
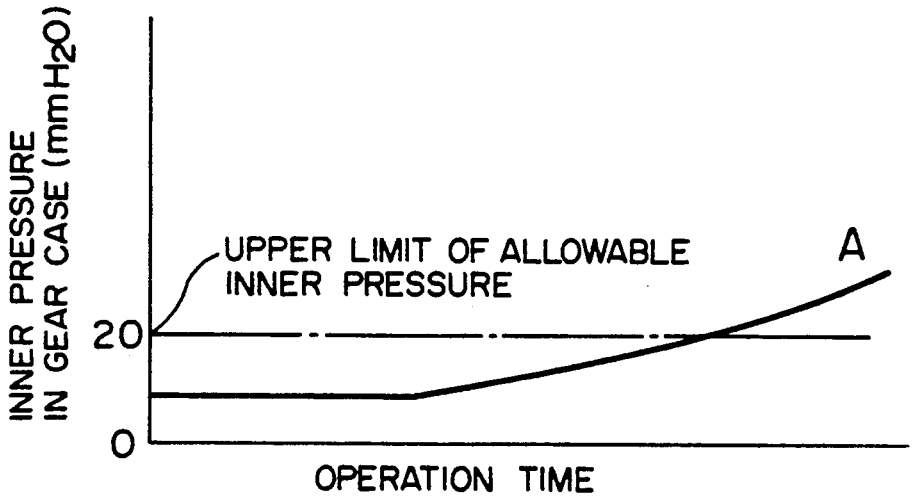
FIG. 3 is a graphical illustration of a relationship between a gear case inner pressure and operational time of the compressor using only a filter.
Figure 4:
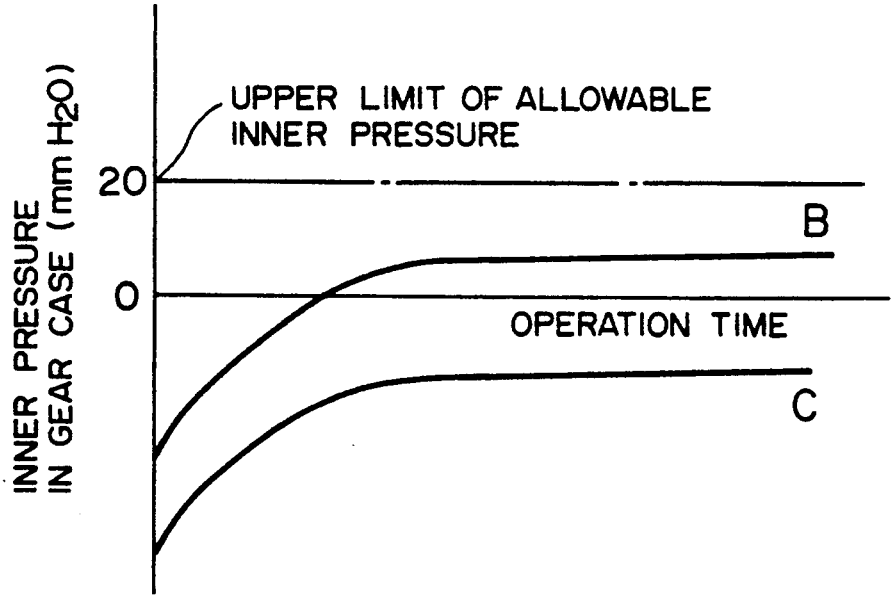
FIG. 4 is a graphical illustration of a relationship between a gear case inner pressure and operational time of a compressor with a construction in accordance with the present invention.

A change of the inner pressure of the gear case 2 is shown as the case of using only a filter in FIG. 3 and as the case of an embodiment of the present invention in FIG. 4. The upper limit of the allowable inner pressure of the gear case 2 is determined as the pressure value of 20 $mmH_2O$. In the case of using only a filter, the inner pressure exceeds the upper limit value in a certain time as shown as a line A in FIG. 3. This is based on a condition that the allowable pressure loss is suppressed at a very low pressure in the case of usage mentioned above and further a very small article of the oil mist must be separated in the filter element. On the other hand, according to an embodiment of the present invention, the inner pressure of the gear case is maintained at less than the upper limit value of the allowable inner pressure as shown as lines B and C in FIG. 4, thereby making stable operation possible.

Figure 5:
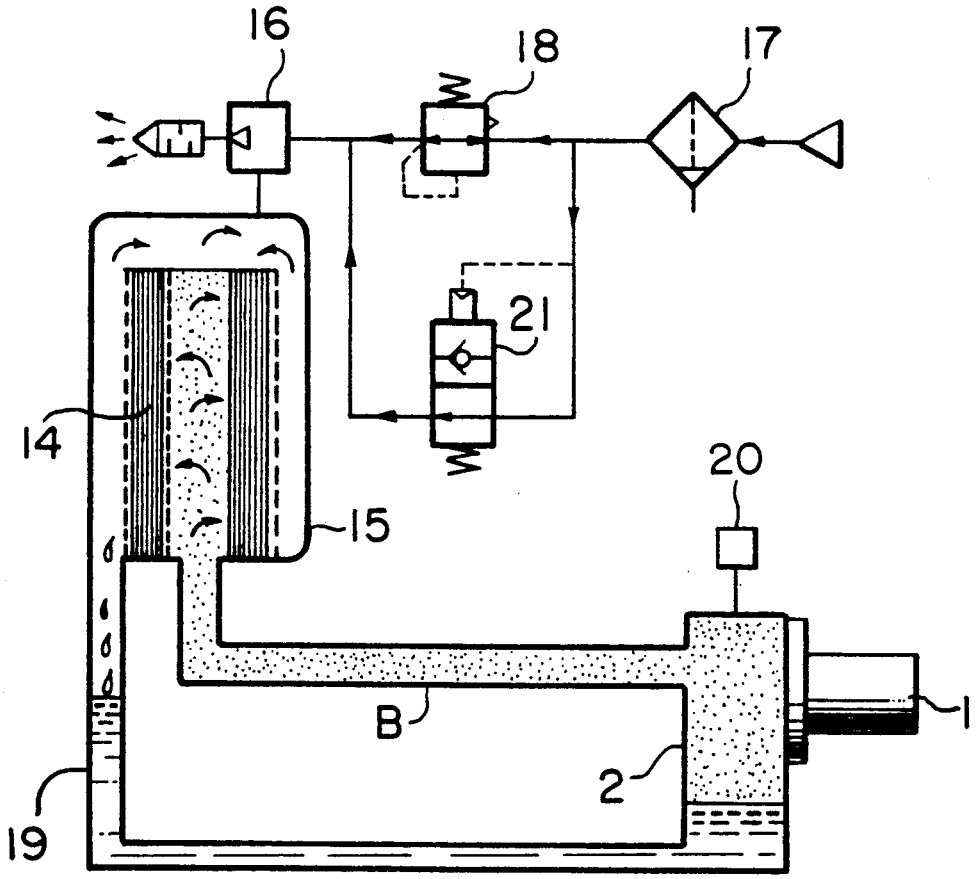
FIGS. 5-9 are schematic views of alternate embodiments constructed in accordance with the present invention.

In FIG. 5, the pressure reducing valve 18 is connected to a by-pass line which is provided with a two-way valve 21. This two-way valve 21 serves as the pneumatic driving two-way valve driven by the inner pressure in the by-pass line, so that it is opened when the inner pressure of the by-pass line is low and is closed when the pressure is increased. Thus, when the pressure of the air supplied to the ejector 16 at the start of the compressor is low, the ability of the ejector 16 may be increased by supplying the air from the by-pass line to the ejector 16.

Figure 6:
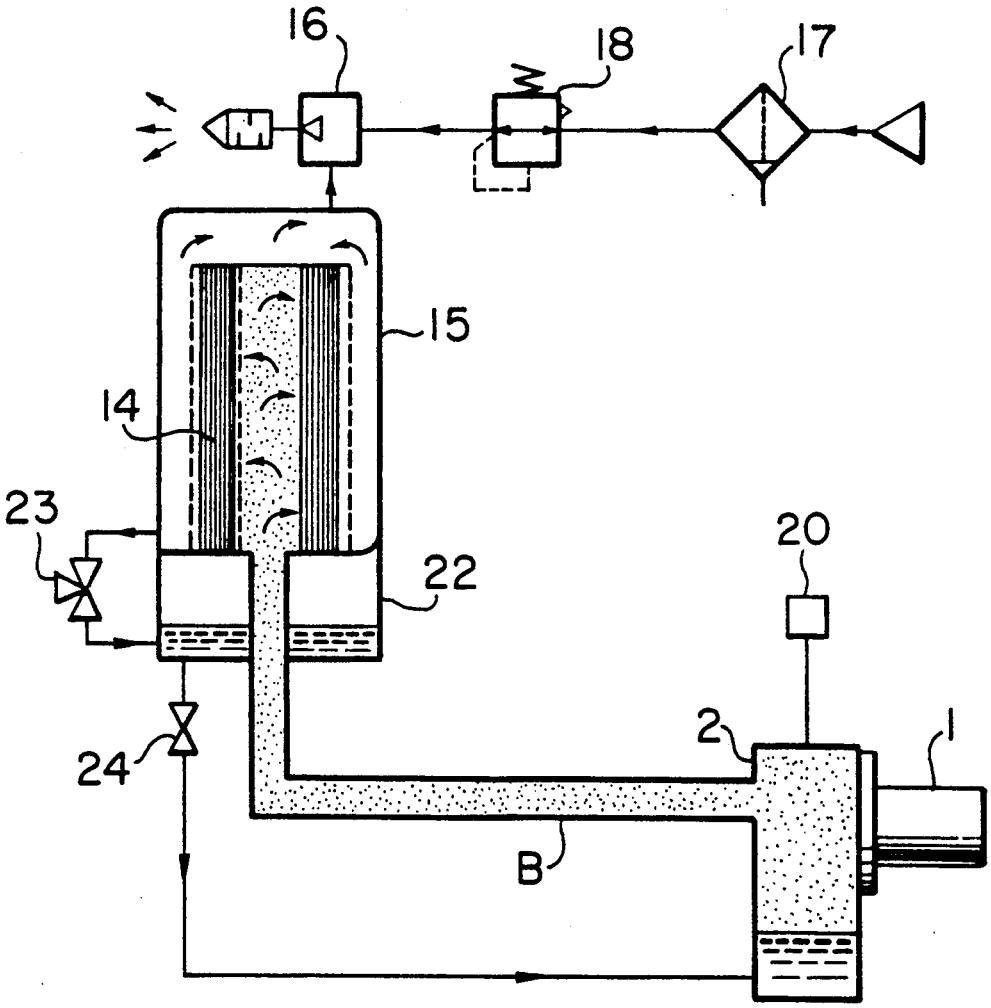

In FIG. 6, a chamber 22 for receiving the oil drop dropping off from the filter element 14 is provided independently on the lower portion of the container 15 for containing the filter element. In the embodiments shown in FIGS. 1 and 5, the separated oil is recovered in an oil reservoir within the gear case 2 directly through a pipe arrangement 19. In those cases, the oil level in the recovery pipe 19 is made higher than that in the filter container 15, with the height being generated by the differential pressure between the inner pressure of the gear case 2 and the pressure second side of the filter element 14. Therefore, unless the differential pressure in the filter element 14 is suppressed at less than that of the recovery pipe 19, the inner portion of the filter container 15 is filled with the oil, whereby there is the possibility of a deterioration in the performance of separation of the filter element 14. However, the embodiment of the present invention as shown in FIG. 6, the oil reservoir chamber 22 is provided independently from the filter container 15, connected to the filter container 15 by a three-way valve 23 and further to the gear case 2 through the two-way valve 24. When the oil collected in the oil reservoir chamber 22 is recovered into the gear case 2, the inner pressure of the oil reservoir chamber 22 is made atmospheric by switching the three-way valve 23, and the two-way valve 24 is opened for the oil to be drawn into the gear case 2. After the oil is recovered, the oil reservoir chamber 22 is communicated with the filter container 15 by switching the three-way valve 23 again and the two-way valve 24 is closed.

Figure 7:
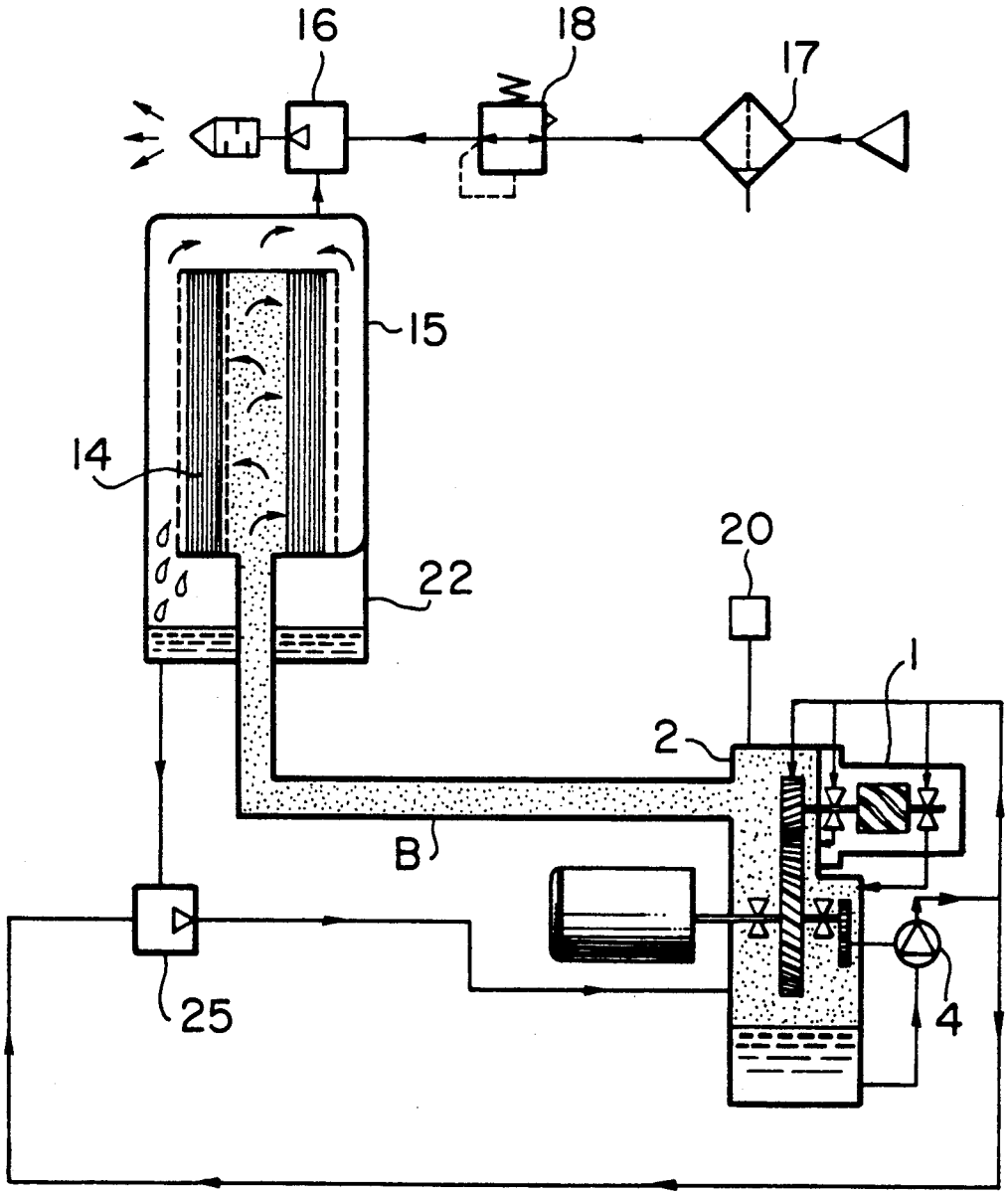

In FIG. 7, the oil collected in the oil reservoir chamber 22 illustrated in the embodiment of FIG. 6 is recovered into the gear case 2 by means of a second ejector 25. In the embodiment of FIG. 7, a part of the oil discharged from an oil pump 4 for forcedly circulating the oil for lubricating a bearing or gears of the compressor is supplied to the second ejector 25, thereby allowing the oil collected in the oil reservoir chamber 22 to be forcedly circulated into the gear case 2 by sucking the oil therein.

Also, in the embodiment of FIG. 7, the (compressor is operated in a problem free manner) when there is pressure for supplying the oil to the ejector 16. However, when compressor is started, there is no air pressure source except for that compressor, the following disadvantages arise. Upon a start-up of the compressor, the compressor simultaneously begins to compress the air and then starts the oil leaks into the gear case 2, whereby the oil starts to flow into the gear case exhaust pipe. On the other hand, the pressure of the oil discharged from the compressor is not immediately increased according to the capacity of the receiver etc. connected to the downstream of the compressor. Therefore, since the ejector 16 does not operate, the second side of the filter element 14 is in such a state that the ejector 16 throttles the portion thereof, wherein the pressure loss which exceeds that of the filter element 14 itself is generated, and the inner pressure of the gear case 2 increases during generating of the pressure loss.

Figure 8:
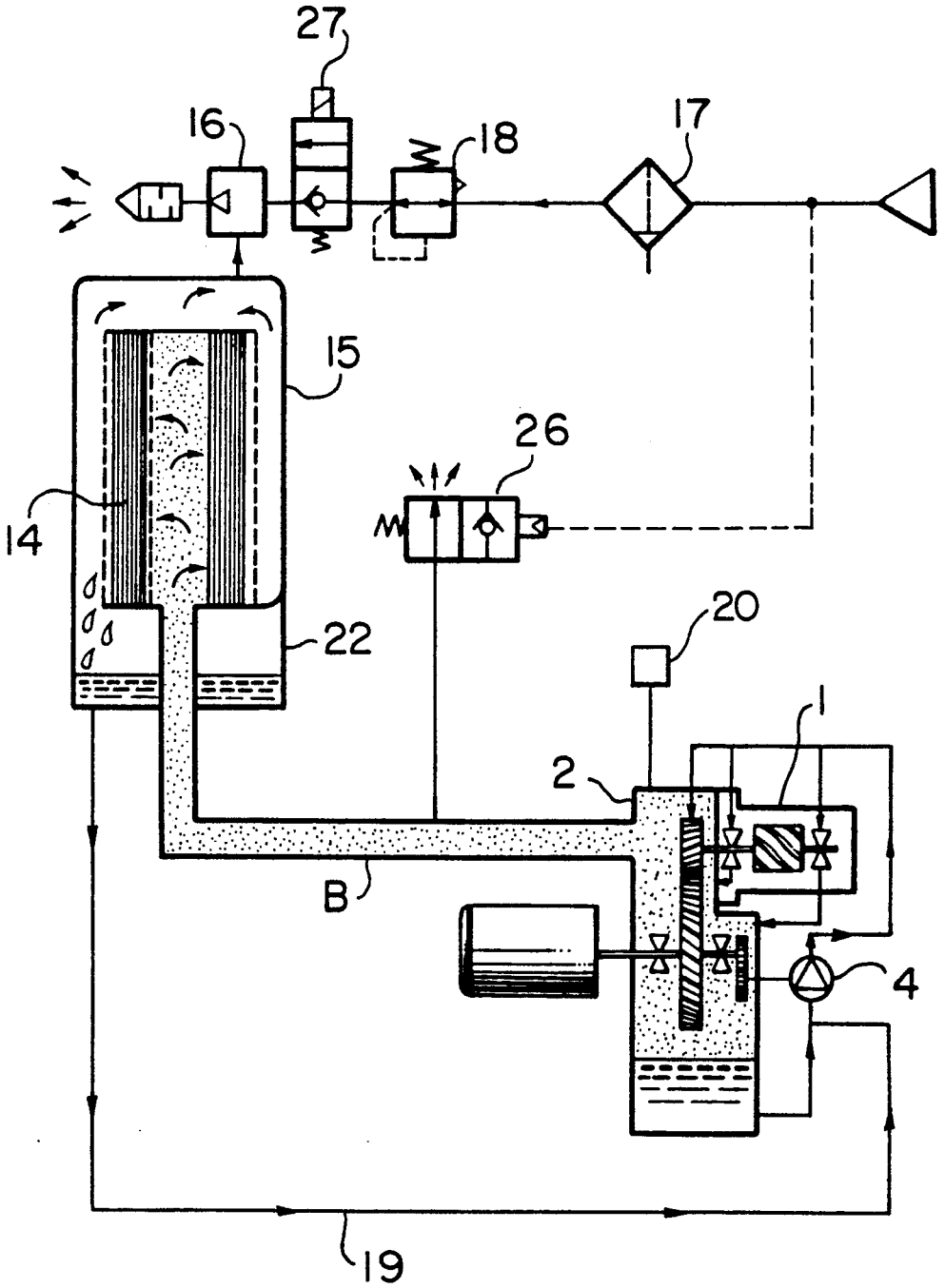
Figure 9:
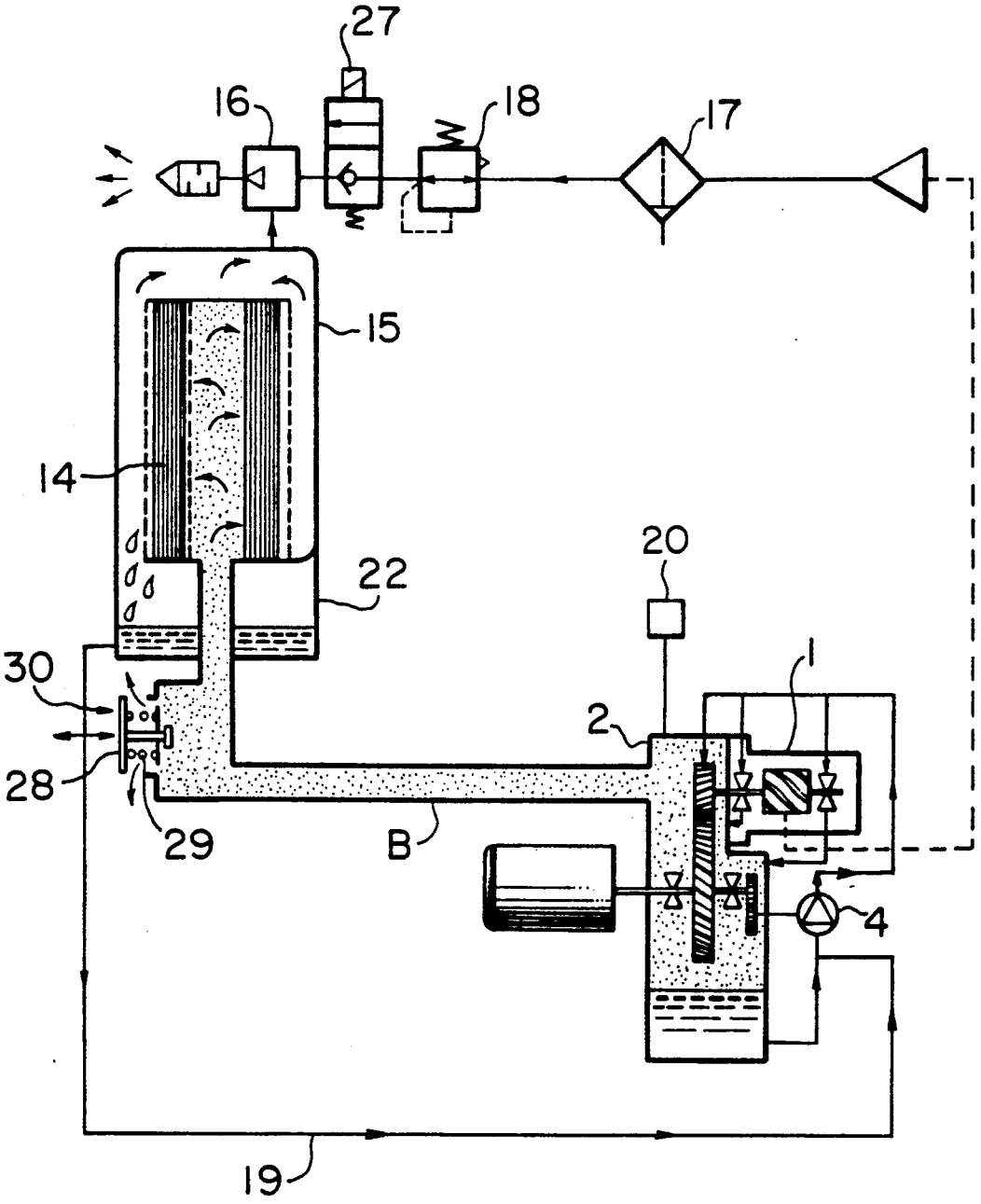

In order to prevent such a state, a two-way valve 26 operated by an air pressure is provided as shown in FIG. 8. This two-way valve 26 has a piston pressed upwardly by a spring force and is opened. If the two-way valve 26 is designed so that the two-way valve 26 is closed by applying the pressure of about 2 $kg/cm^2$ g on the upper portion of the two-way valve 26, it is possible to open the inner pressure of the gear case 2 to an atmosphere through the two-way valve 26 until the ejector 16 can be operated by making the operating pressure of the two-way valve 26 the same pressure as that supplied to the ejector 16. In such a state, although a little amount of the oil mist is discharged from the two-way valve, the condition that the compressor has no pressure is during a short time and in this time an amount of the excharged oil mist is very small. Accordingly, there is no problem of discharging the oil mist from the two-way valve 26. In FIG. 9, a safety valve 30 is provided in place of the two-way valve 26. A valve plate 28 of the safety valve 30 has a state that the valve 30 is usually opened by a weak spring 29. Accordingly, the valve plate 28 is opened until the ejector 16 is operated to make the inner pressure of the gear case 2 negative, thereby preventing the inner pressure of the gear case 2 from increasing. When the ejector 16 starts to operate and the inner pressure of the gear case 2 becomes a negative pressure, the valve plate 28 overcomes the force of the weak spring 29 according to the differential pressure between atmospheric pressure and the negative pressure and is closed by the differential pressure. Thus, in the usual time, it is possible for the compressor apparatus to operate in the same state as in the safety valve 30 is not used.

Further, in the embodiment of FIG. 8, an pipe arrangement 19 is provided in order to communicate with the suction port of the oil pump 4 provided for circulating the oil from the lower portion of the filter container 15 and supplying it to a bearing, gears etc. of the compressor.

The oil separated in the filter element 14 drips into the lower portion of the container 15. However, since the pressure of this container portion is a negative pressure of about $-500$ $mmH_2O$–1000 $mmH_2O$ and the gear case inner pressure generated by suctioning the gear case 2 through the filter element 14 is higher than that of the second side of the filter element 14, this pressure corresponds to the pressure loss of the oil mist generated by passing it through the filter element 14. Therefore, it is impossible to naturally recover the dripped and collected oil into the gear case 2. This is undesirable because it is necessary to periodically recover the oil collected in the container 15 by a manual actuator. Then, if the structure shown in FIG. 8 is adopted, the pressure of the suction side of the oil pump 4 is usually $-1500$–2000 $mmH_2O$ and the separated oil at all time can be automatically recovered into an oil circulating circuit without adding of special structure and devices.

Also, as shown in FIG. 8, an electromagnetic valve 27 may be provided in the pipe arrangement for supplying the air to the ejector 16 so that this electromagnetic valve 27 is closed when the compressor is stopped. This electromagnetic valve 27 is operated in such a state that when a plurality of compressors are operated, the pressure of the air supplied to the ejector 16 is loaded thereon if one compressor is stopped and other compressors are operated, thereby allowing the gear case inner pressure to be a negative pressure by operation of the ejector 16.

Thus, it is effective to provide the electromagnetic valve 27 in the pipe arrangement of the compressed air in order that there is the risk of making the oil in the gear case 2 flow in reverse through the oil recovery pipe 19 to suck the oil into the container 15 and so that the compressed air is not wastefully consumed during no operation of the compressor.

In such an embodiment it is possible to ensure the removal, separation and recovery of the oil mist discharged from the gear case 2 in normal operation by an inexpensive structure and without increasing of the gear case inner pressure.

As mentioned before, it is possible according to the present invention to remove the oil mist discharged from the gear case without necessary of arranging the exhaust pipe of the gear case in outdoors as conventionally effected, without the necessity of using a large-scale, expensive apparatus such as the filter provided with a blower and an electric dust collector and an electric power for operating such apparatus, and without increasing of the inner pressure of the gear case (i.e. without losing reliability of a shaft seal in the compressor). Moreover, since a part of the compressed gas obtained from an oil-free screw compressor itself can serve as the compressed gas for driving the vacuum ejector connected to the filter for removing the oil mist, the compressor apparatus can be designed so as to simplify its structure.

What is claimed is:

1. An oil-free screw compressor apparatus comprising:

a gear case integrally mounted on the oil-free screw compressor and containing gears for driving a rotor shaft of said compressor, oil stored in a lower portion of said gear case being supplied therefrom to bearings and gears of said compressor, and oil, subsequent to lubrication of said bearings and gears, and gas leaking through an inner shaft seal mechanism of said compressor being discharged into said gear case;

a gear case exhaust pipe for preventing inner pressure of said gear case from increasing due to said gas leaking from said compressor, said gear case exhaust pipe being connected to said gear case;

a closed filter container containing a filter element for separating oil mist, said closed filter container being connected to said gear case exhaust pipe at a first side of said filter element; and a vacuum ejector for making pressure at a second side of the filter element contained in said closed filter container negative pressure, said vacuum ejector having a suction port connected to said closed filter container at the second side of the filter element.

2. An oil-free screw compressor according to claim 1, wherein an adjustable pressure reducing valve is provided in a supply line of said ejector operating compressed gas.

3. An oil-free screw compressor according to claim 3, wherein a two-way valve for by-passing said pressure reducing valve is provided so as to supply the compressed air directly to said vacuum ejector through said two-way valve when a pressure of the compressed air supplied to said vacuum ejector is low.

4. An oil-free screw compressor comprising:

a gear case integrally mounted on the oil-free screw compressor and containing gears for driving a rotor shaft of said compressor, oil in said gear case being supplied therefrom to said compressor, and oil discharged and gas leaking from said compressor being discharged into said gear case;

a gear case exhaust pipe connected to said gear case;

a filter container connected to said gear case exhaust pipe and containing a filter element for separating oil mist; and a vacuum ejector for making pressure of a second side of the filter element contained in said filter container negative pressure, said vacuum ejector having a suction port connected to the second side of the filter element in said container, and wherein a part of compressed air produced by said oil-free screw compressor is used as ejector operating compressed gas supplied to said vacuum ejector.

5. An oil-free screw compressor according to claim 4, wherein an adjustable pressure reducing valve is provided in a supply line of said ejector operating compressed gas.

6. An oil-free screw compressor apparatus according to claim 4, wherein an oil recovery pipe for recovering the oil separated by said filter element connects a lower portion of the second side of the filter element to the gear case.

7. An oil-free screw compressor according to claim 4, wherein an oil reservoir chamber for receiving the oil separated by said filter element is independently mounted on a lower portion of said filter container, an oil recovery pipe is provided for communicating the lower portion of the oil reservoir chamber to the gear case.

8. An oil-free screw compressor according to claim 4, wherein a safety valve is provided at an upstream side of said filter element to be opened when the first side pressure of the filter element is unusually increased.

9. An oil-free screw compressor apparatus according to any one of claims 1, 2 or 3, wherein an oil recovery pipe for recovering the oil separated by said filter element connects a lower portion of the second side space of the filter element to the gear case.

10. An oil-free screw compressor according to any one of claims 1, 2 or 3, wherein an oil reservoir chamber for receiving the oil separated by said filter element is independently mounted on a lower portion of said filter container, and an oil recovery pipe is provided for communicating the lower portion of the oil reservoir chamber to the gear case, said oil reservoir chamber being connected to said second side space of the filter container through a three-way valve, and said oil recovery pipe having an opening and closing valve provided therein.

11. An oil-free screw compressor according to any one of claims 1, 2 or 3, wherein an oil reservoir chamber for receiving the oil separated by said filter element is provided independently on the lower portion of the second side space of the filter element in said filter container in such a manner as to communicate therewith, said oil reservoir chamber having a second ejector and a pipe arrangement for sucking and recovering the oil of said chamber into the gear case.

12. An oil-free screw chamber according to any one of claims 1, 2 or 3, wherein said gear case has a pressure sensor provided for sensing inner pressure of the gear case, so that an alarm is given on the basis of the pressure sensed by said pressure sensor when pressure loss of said filter element is unusually increased.

13. An oil-free screw compressor according to any of one of claims 1, 2 or 3, wherein a safety valve is provided at an upstream side of said filter element to be opened when the first side pressure of the filter element is unsually increased.

14. An oil-free screw compressor comprising:

a gear case integrally mounted on an oil-free screw compressor and containing gears for driving a rotor shaft of said compressor, oil in said gear case being supplied therefrom to said compressor, and oil discharged and gas leaking from said compressor being discharged into said gear case;

a gear case exhaust pipe being connected to said gear case;

a filter container connected to said exhaust pipe and containing a filter element for separating oil mist;

a vacuum ejector for making pressure of a second side space of the filter element contained in said container negative pressure, said vacuum ejector having a suction port connected to the second side space of the filter element in said container, and a two-way valve being opened or closed by pneumatic operation, said two-way valve having one way connected to space of the portion communicating said gear case to said filter element and other way opening to atmosphere.

15. An oil-free screw compressor according to claim 14, wherein a pressure of the compressed gas produced by said oil-free screw compressor is used as operating air for said pneumatic operating valve.

16. An oil-free screw compressor according to one of claims 1 or 4, wherein a relief valve opened and closed by a pressure of 0–30 $mmH_2O$ is provided, said relief valve communicating with the gear case to prevent an inner pressure of the gear case from increasing above a predetermined limit.

17. An oil-free screw compressor according to claim 16, wherein an oil recovery pipe for recovering the oil separated by said filter element is provided in a pipe arrangement communicating a lower portion of the second side of the filter element in said closed filter container to a suction side of an oil pump provided on said oil-free screw compressor apparatus.

18. An oil-free screw compressor according to claim 10, wherein an automatic valve closing during no operation of the compressor is provided in a pipe arrangement for supplying compressed air to said vacuum ejector.

* * * * *